United States Patent [19]

Kimura

[11] Patent Number: 4,813,797

[45] Date of Patent: Mar. 21, 1989

[54] DOT PRINTER

[75] Inventor: Tutomu Kimura, Shizuoka, Japan

[73] Assignee: Tokyo Electric Co., Ltd., Tokyo, Japan

[21] Appl. No.: 880,091

[22] Filed: Jun. 30, 1986

Related U.S. Application Data

[63] Continuation of Ser. No. 580,810, Feb. 16, 1984, abandoned.

[30] Foreign Application Priority Data

Feb. 22, 1983 [JP] Japan ..... 58-28899

[51] Int. Cl.[4] ..... B41J 3/12; B41J 27/18

[52] U.S. Cl. ..... 400/124; 101/93.05; 400/470

[58] Field of Search ..... 400/124, 470–471.1; 101/93.05

[56] References Cited

U.S. PATENT DOCUMENTS

| | | | |
|---|---|---|---|
| 2,842,244 | 7/1958 | Gibson | 400/54 X |
| 3,596,285 | 7/1971 | Gottwald | 400/126 X |
| 4,279,523 | 7/1981 | Ringle | 400/54 X |

FOREIGN PATENT DOCUMENTS

| | | | |
|---|---|---|---|
| 2546835 | 4/1977 | Fed. Rep. of Germany | 400/124 |
| 95682 | 3/1981 | Japan | 400/124 |
| 159662 | 10/1982 | Japan | 400/124 |
| 5275 | 1/1983 | Japan | 400/124 |

*Primary Examiner*—Paul T. Sewell

*Attorney, Agent, or Firm*—Oblon, Fisher, Spivak, McClelland & Maier

[57] ABSTRACT

A dot printer wherein magnetic ink is fed by magnetic-flux generating means to a slit formed between a pair of magnetic poles, and needles are selectively driven so that tips thereof furnished with the magnetic ink are brought into contact with a recording paper to perform printing with the ink. Since the magnetic ink is fed to the slit only during the operation of the printer, the ink is not present in the slit when no printing operation is being performed, hence preventing occurrence of a trouble that may otherwise be induced by evaporation of the magnetic ink.

6 Claims, 3 Drawing Sheets

DOT PRINTER

This application is a Continuation, of application Ser. No. 580,810, filed Feb. 16, 1984, abandoned.

FIELD OF THE INVENTION

The present invention relates to a dot printer and, more particularly, to a type which forms dots on a recording paper by furnishing the tips of a multiplicity of needles with ink and then driving the needles selectively to transfer the ink onto the recording paper, thereby printing a character, figure, pattern or the like on the paper with an aggregation of such dots.

OBJECTS OF THE INVENTION

It is a first object of the present invention to prevent unnecessary evaporation of magnetic ink.

A second object of the invention resides in achieving simplified supply of magnetic ink into a slit.

A third object of the invention is to realize uniform supply of magnetic ink to the entirety of a slit.

Other objects and advantages of the invention will become apparent from the following description.

DESCRIPTION OF THE PRIOR ART

Figure 1:
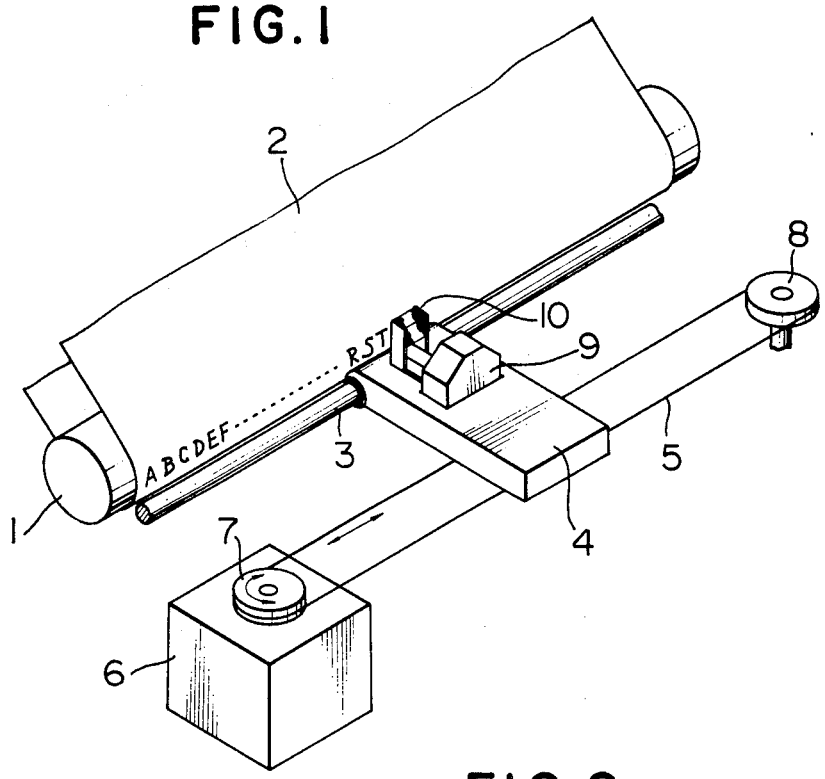
FIG. 1 is a perspective view of an exemplary embodiment of the present invention.
Figure 2:
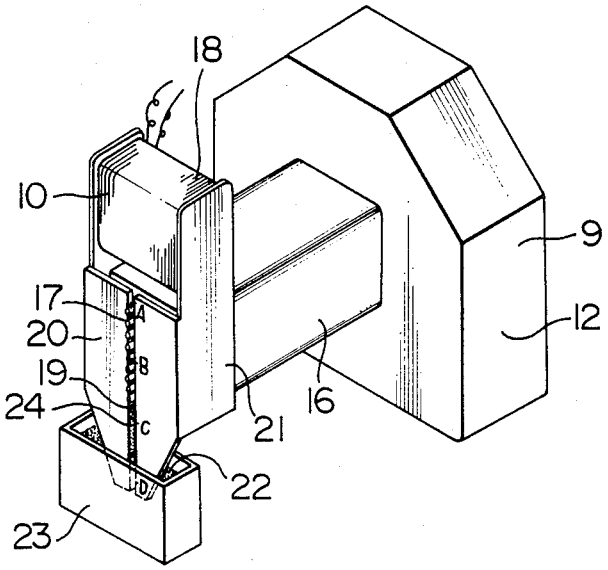
FIG. 2 is a perspective view of principal components in the embodiment.
Figure 3:
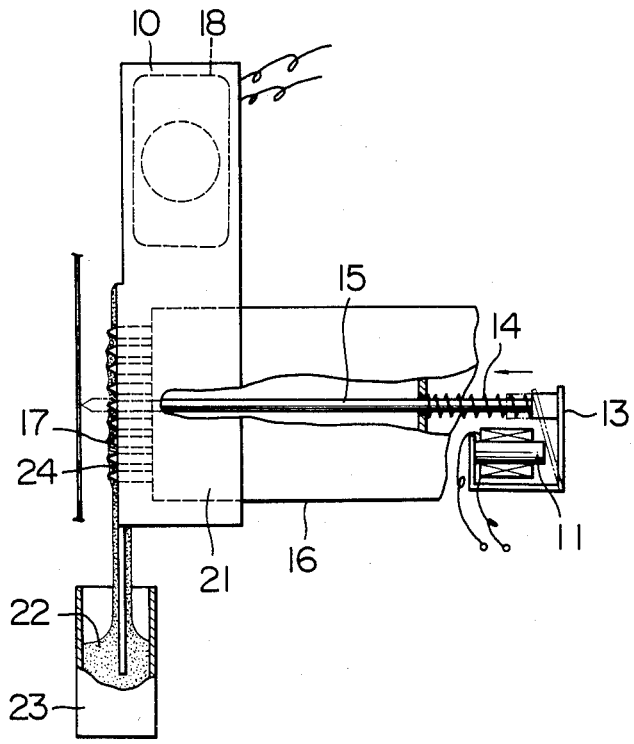
FIG. 3 is a partially cutaway side view of the principal components shown in FIG. 2.
Figure 4:
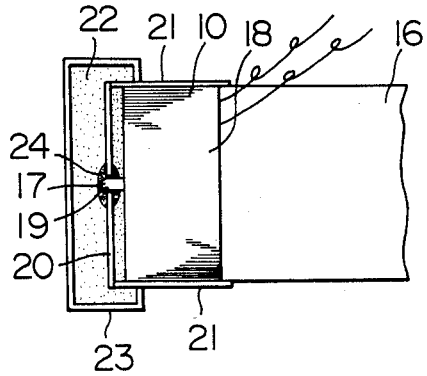
FIG. 4 is a plan view of the components in FIG. 3.
Figure 5:
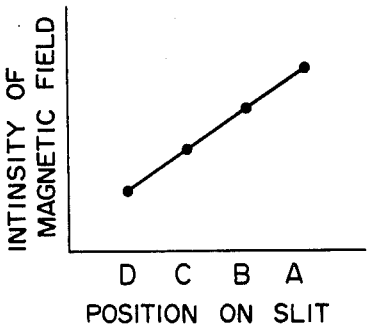
FIG. 5 graphically shows the relationship between the position of a magnetic field slit and a field intensity.

Of the conventional dot printers equipped with needles, there are generally known a type using ink ribbon and another type using pressure sensitive paper, each of which utilizes kinetic energy based on the motion of the needles and performs its printing operation by causing the needles to impact against a recording member. Consequently, a disadvantage is unavoidable with respect to a considerable noise emitted during the printing operation.

For the purpose of eliminating such a disadvantage, there has been proposed an improved dot printer as disclosed in Italian Patent Application (IT) No. [31]68834-A/79, published on Sept. 19, 1979. This published application discloses a dot printer wherein a printing operation is performed by first feeding magnetic ink between mutually opposed magnetic poles to form an ink film, then placing the tips of needles in the ink film to cause deposition of the magnetic ink thereto, and driving selected needles to bring the tips thereof into contact with a recording paper to form desired dots with the ink. In such a type, however, there exist some problems including that evaporation of the magnetic ink occurs to eventually increase its concentration, hence varying the print density. Furthermore, a residual of the evaporated ink adheres to the slit or needles, thereby inducing impediment to execution of smooth printing.

DESCRIPTION OF THE PREFERRED EMBODIMENT

A printing paper (2) serving as a recording member is wound around a platen (1) which confronts a carriage (4) reciprocated along a guide shaft (3) disposed in parallel with the platen (1). A driving wire (5) is connected to the carriage (4) and is wound around both a driving pulley (7) operatively connected to a carriage motor (6) and a driven pulley (8) spaced apart from the driving pulley (7).

The carriage (4) is equipped with a needle head (9) and an ink-film forming unit (10). The needle head (9) has a driving section (12) where a plurality of needle magnets (11) are arrayed, and a moving iron piece (13) is pivotably attached to each of the needle magnets (11). The base ends of the individual needles (15) biased elastically by means of return springs (14) so as to be pressed against the associated one of the moving iron pieces (13). The needles (15) (e.g. nine in number) are guided by means of needle guide members (16) in such a manner that tips (17) thereof are aligned vertically in a row. The needles (15) are composed of stainless steel and are arrayed at a pitch of 0.36 mm, each having a diameter of 0.2 mm with its tip tapered to a diameter of 0.15 mm.

The aforesaid ink-film forming unit (10) has an electromagnetic coil (18) in its upper portion, and the two terminals of the coil (18) are coupled to side walls (21) integral with magnetic pole plates (20) which are opposed to each other to form a slit (19) therebetween. The magnetic pole plates (20) extend downward beyond the region of the slit (19) through which the needles (15) pass and project at the fore ends thereof into an ink storage vessel (23) where magnetic ink (22) is stored. A voltage of 0.7 to 1.0 volt is applied to the electromagnetic coil (18) to produce an output of 150 ampere-turn. The magnetic ink (22) has a magnetic induction of 200 gauss and a viscosity of 20 cp or less. The ink storage vessel (23) is so located that, upon energization of the electromagnetic coil (18), a magnetic ink film (24) is formed over the entirety of the slit (19). With respect to regions A, B, C and D of the pole plates (20), there exist such a magnetic gradient that the field intensity in the slit (19) becomes gradually greater from the region D toward the region A. Thus, it becomes possible to achieve satisfactory formation of a magnetic ink film (24) having a uniform thickness in the slit (19) without gravitational influence.

In the structure mentioned above, the electromagnetic coil (18) is never energized when no printing operation is being performed, so that the magnetic ink (22) is not present in the slit (19) and consequently there arises no problem of clogging the slit (19) with a residual derived from evaporation of the ink. In addition, there never occurs an undesired phenomenon that the print density is varied due to the increased concentration of the magnetic ink (22). However, during a printing operation the electromagnetic coil (18) is energized, the magnetic ink (22) is attracted into the slit (19), and an ink film (24) is formed. In this case, the tip (17) of each driven needle (15) is rendered wet with the magnetic ink (22) due to the presence of the ink film (24).

When a selected needle magnet (11) is energized with a pulsed current in response to a print command, the associated needle (15) is driven and displaced toward the recording paper (2), and after contact of the tip thereof with the paper (2), the needle (15) is returned to its former home position. As a result of such contact, the magnetic ink (22) on the needle tip (17) is transferred therefrom to the paper (2), thereby forming a dot. The top (17) of the needle (15) returned to its home position is placed again in the magnetic ink film (24) to be wet with the ink (22). Thus, desired noiseless printing can be accomplished by repetition of the above operation.

Figure 6:
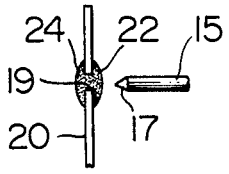
FIG. 6 is a partial sectional view of a modified example.

In addition to the foregoing embodiment where the tip (17) of each needle (15) is placed in the magnetic ink film (24), it is possible to modify the structure as illustrated in FIG. 6 where the tip (17) is spaced apart slightly from the magnetic ink film (24) on the reverse side with respect to the recording paper (2). In the latter embodiment, the magnetic ink film (24) functions practically as an ink ribbon.

Although in the above embodiment an electromagnet with a coil (18) is employed as means for feeding the magnetic ink (22) to the slit (19), the structure may be so modified that the coil (18) is energized synchronously with turning on a power switch (25).

The electromagnet may be replaced with a permanent magnet. In this case, magnetic flux generation in the slit (19) can be controlled by shifting the permanent magnet toward or away from the pole plates (20). In another modification, magnetic shield means such as an aluminum plate may be interposed between the permanent magnet and the pole plates (20).

Furthermore, with regard to the means for varying the flux density vertically in the slit (19), a proper magnetic gradient may be provided by increasing the slit width gradually from the upper portion toward the lower portion.

What is claimed is:

1. A dot printer comprising:

(a) an ink storage vessel which, during use of the dot printer, stores magnetic ink;

(b) a pair of magnetic pole plates disposed opposite one another to form a vertical slit therebetween, said pair of magnetic pole plates projecting downwardly into said ink storage vessel so that, during use of the dot printer, the vertical slit between said pair of magnetic pole plates is in direct fluid communication with the magnetic ink stored in said ink storage vessel, whereby the magnetic ink is fed into the vertical slit between said pair of magnetic pole plates directly from said ink storage vessel and the vertical slit between said pair of magnetic pole plates is the sole feed for the magnetic ink;

(c) a plurality of needles disposed one above the other in position to be driven through an upper region of the vertical slit between said pair of magnetic pole plates, the vertical slit between said pair of magnetic pole plates being much longer than said upper region;

(d) driving means for selectively driving said plurality of needles through said upper region of the vertical slit between said pair of magnetic pole plates to deposit drops of magnetic ink on a recording medium;

(e) flux generating means for applying a magnetic flux to said pair of magnetic pole plates so as to form a magnetic ink film in the vertical slit between said pair of magnetic pole plates, the flux density of magnetic flux between said pair of magnetic pole plates becoming gradually greater from the lower portion of the vertical slit between said pair of magnetic pole plate toward said upper region of the vertical slit between said pair of magnetic pole plates; and (f) a power switch operatively connected to said flux generating means so that said flux generating means is energized, causing the magnetic ink film to be formed in the vertical slit between said pair of magnetic pole plates, when said power switch is turned on and so that said flux generating means is not energized when said power switch is turned off, thereby causing magnetic ink in the magnetic ink film to return to said ink storage vessel.

2. A dot printer as recited in claim 1 wherein said flux generating means is an electromagnetic coil situated above the vertical slit between said pair of magnetic pole plates.

3. A dot printer as recited in claim 1 wherein said flux generating means is an electromagnetic coil disposed between said pair of magnetic pole plates.

4. A dot printer comprising:

(a) an ink storage vessel which, during use of the dot printer, stores magnetic ink;

(b) a pair of magnetic pole plates disposed opposite one another to form a vertical slit therebetween, said pair of magnetic pole plates projecting downwardly into said ink storage vessel so that, during use of the dot printer, the vertical slit between said pair of magnetic pole plates is in direct fluid communication with magnetic ink stored in said ink storage vessel, whereby the magnetic ink is fed into the vertical slit between said pair of magnetic poles plates directly from said ink storage vessel and the vertical slit between said pair of magnetic pole plates is the sole feed for the magnetic ink;

(c) a plurality of needles disposed one above the other in position to be driven through an upper region of the vertical slit between said pair of magnetic pole plates, the vertical slit between said pair of magnetic pole plates being much longer than said upper region;

(d) drive means for selectively driving said plurality of needles through said upper region of the vertical slit between said pair of magnetic pole plates to deposit drops of magnetic ink on a recording medium; and (e) electromagnetic means for applying a magnetic flux to said pair of magnetic pole plates so as to form a magnetic ink film in the vertical slit between said pair of magnetic pole plates when said electromagnetic means is energized and to cause magnetic ink in the magnetic film to return to said ink storage vessel when said electromagnetic means is not energized, the flux density of the magnetic flux between said pair of magnetic pole plates becoming generally greater from the lower portion of the vertical slit between said pair of magnetic pole plates to said upper region of the vertical slit between said pair of magnetic pole plates.

5. A dot printer as recited in claim 4 wherein said flux generating means is an electromagnetic coil situated above the vertical slit between said pair of magnetic pole plates.

6. A dot printer as recited in claim 4 wherein said flux generating means is an electromagnetic coil disposed between said pair of magnetic pole plates.

* * * * *